United States Patent [19]

Hargis

[11] 4,437,767

[45] Mar. 20, 1984

[54] LOWER SUPPORT FOR SINGLE SCREW MIXER

[75] Inventor: Richard A. Hargis, Cincinnati, Ohio

[73] Assignee: Day Mixing Company, Cincinnati, Ohio

[21] Appl. No.: 472,073

[22] Filed: Mar. 4, 1983

[51] Int. Cl.[3] ..... B01F 7/30

[52] U.S. Cl. ..... 366/287; 366/331

[58] Field of Search ..... 366/241, 242, 243, 244, 366/287, 290, 318, 331; 403/26, 157, 158; 464/134; 277/DIG. 4

[56] References Cited

U.S. PATENT DOCUMENTS

| | | | |
|---|---|---|---|
| Re. 15,746 | 1/1924 | Westerman | 366/287 |
| 2,575,602 | 11/1951 | Stillwagon, Jr. | 464/134 |
| 2,753,161 | 7/1956 | Fye | 366/331 |
| 4,153,372 | 5/1979 | Nauta | 366/287 |

FOREIGN PATENT DOCUMENTS

| | | | |
|---|---|---|---|
| 702,875 | 2/1965 | Canada | 366/287 |

*Primary Examiner*—Robert W. Jenkins

*Assistant Examiner*—Arthur D. Dahlberg

*Attorney, Agent, or Firm*—Frost & Jacobs

[57] ABSTRACT

The lower support for single screw mixer of this invention is comprised of a support shaft rotatably secured in the bottom of a mixer having an inverted, truncated cone configuration. A connecting shaft is rotatably disposed within a bearing housing fixed to the lower end of the screw flight shaft disposed along the periphery of the mixer. The screw is attached to an orbit arm which rotates about the center axis of the mixer and through which the screw is rotated at relatively high speeds. Such relatively high speeds, however, are not, by virture of the bearing arrangement contained within the bearing housing fixed to the screw, imparted to the connecting shaft. The support shaft 20 and connecting shaft 36 are connected to one another by a pin arrangement which accommodates deflections imparted to the screw by the forces encountered during mixing. These shafts, however, rotate only at orbit speed, the connecting shaft moving only in response to movement of the orbit arm, not to the rotational speed of the screw itself.

7 Claims, 3 Drawing Figures

LOWER SUPPORT FOR SINGLE SCREW MIXER

TECHNICAL FIELD

This invention resides in a lower support for a single screw mixer of the Day nauta-type, an industrial mixer for achieving intimate blending of powders, pastes, creams, doughs, plastisols and other materials, including granules, in short mixing time. The screw flight agitator of this type mixer, rotating on its own axis while orbiting the periphery of the conical tank, sets up three distinct intermixing currents in the batch at the same time. The screw agitator, turning on its axis, produces a lifting action as it spirals the materials in an upward flow in the tank. At the same time, orbiting the tank, the screw removes material away from the wall and deflects it into the center of the tank setting up a second, wider spiral current throughout the batch. And the material lifted upwardly by the screw gravitates downwardly, thoroughly intermixing with material being spiraled upwardly, resulting in a good intermingling of all ingredients.

Customarily the screws of these Day nauta-type mixers are driven from and through the end of an upper swing or orbit arm, coupling means being provided in the connection between the upper end of the screw and the outer end of the orbit arm to compensate for axial movement which may be imparted to the screw by the forces, including heat, encountered during mixing. This kind of upper arrangement makes it necessary to provide some sort of positive support for the lower end of the screw.

BACKGROUND ART

Spanning a number of years, many U.S. patents have issued to one Constant Johan Nauta of Overveen, Netherlands relating to single screw and multiple screw mixers. U.S. Pat. No. 3,109,633 Nauta may be representative of a single screw mixer while U.S. Pat. No. 3,450,390 Nauta may be representative of a multiple screw mixer. Although these patents are of interest, it should be noted that no search of the U.S. patent art has been conducted with reference to the specific invention shown, described and claimed herein.

Generally, in multiple screw mixers the driving connection at the upper end of the screw and the outer end of the orbit arm is such as to support the screw, the lower end of the screw simply being received in a suitable guide means on a support arm which rotates along with the orbit arm. In a representative single screw mixer, however, the screw is actually supported at its lower end, rather than just guided, the connection at the upper end of the screw to the outer end of the orbit arm being such as to not only drive the screw but also to permit a certain amount of flex to accommodate screw distortions which may be occasioned by the forces encountered during mixing. It is necessary, therefore, to positively support the lower end of the screw and this is wherein the improvements of this invention reside.

In addition to the single point contact disclosed in the U.S. Pat. No. 3,109,632 Nauta, three other bottom supports have been utilized. One of these has comprised a universal joint in effect connecting the screw at its lower end to the bottom of the truncated, inverted cone comprising the single screw mixer. The universal joint connects the screw to a support shaft in such manner that the screw and support shaft rotate together at screw speed which may in the neighborhood of 30 to 120 rpms; additionally the joint must accommodate the orbit arm speed of another 1 to 4 rpms. This universal joint is thus subjected to much wear and is expensive to manufacture and maintain; furthermore, it may also be contaminated by the product being mixed. Another arrangement involved the use of a ball like configuration on the lower end of the screw, such configuration being received within a bearing provided with a mating cover whereby to achieve what has been termed a captive ball support. Again, however, the arrangement connecting the lower end of the screw to the lower end of the mixer involves a bearing surface which must accommodate parts moving at the relatively high screw speeds encountered. This relatively high screw speed, along with the load which the bearing surface must support, necessitates that the bearing surface be made of specially hardened steel and involves the use of difficult and expensive manufacturing techniques.

Yet another manner of supporting the lower end of the screw has been to provide a pintle in the lower end of the mixer and a block in the lower end of the screw configured to ride on the rounded upper end of the pintle. Even with this arrangement, however, the bearing requirements above mentioned must be met. And the possibility of contamination earlier mentioned is also a factor with these latter arrangements as well.

It is believed that the present invention fully overcomes the kinds of problems encountered by the prior art and briefly reviewed above.

DISCLOSURE OF THE INVENTION

The lower support for single screw mixer comprising the instant invention includes a flanged support post fixed to the bottom of the truncated, inverted cone comprising the mixer itself. Within this post there is located a support shaft provided with axial thrust bearings and sleeve bearings as well. A connecting shaft is pinned to the upper end of the support shaft. A bearing housing containing suitable bearings is fixed to the lower end of the screw and located about the connecting shaft but not drivingly connected thereto at screw speed. The connecting shaft and support shaft, therefore, will move at orbit speed as the orbit arm turns and this is on the order of 1 to 4 rpms. The screw speed of 30 to 120 rpms will not be imparted to the connecting shaft and support shaft by reason of the bearings disposed about the connecting shaft and located within the bearing housing.

The pin arrangement between the support shaft and connecting shaft thus achieves a sort of "universal" joint but without the "universal" parts being subjected to screw speeds. This greatly increases the life of the lower support while at the same time achieving a positive support for the screw which will enable the screw to be rotated in either direction, as mixing conditions require, without loss of support or connection with the mixer bottom.

DETAILED DESCRIPTION OF THE INVENTION

Figures 1, 3:
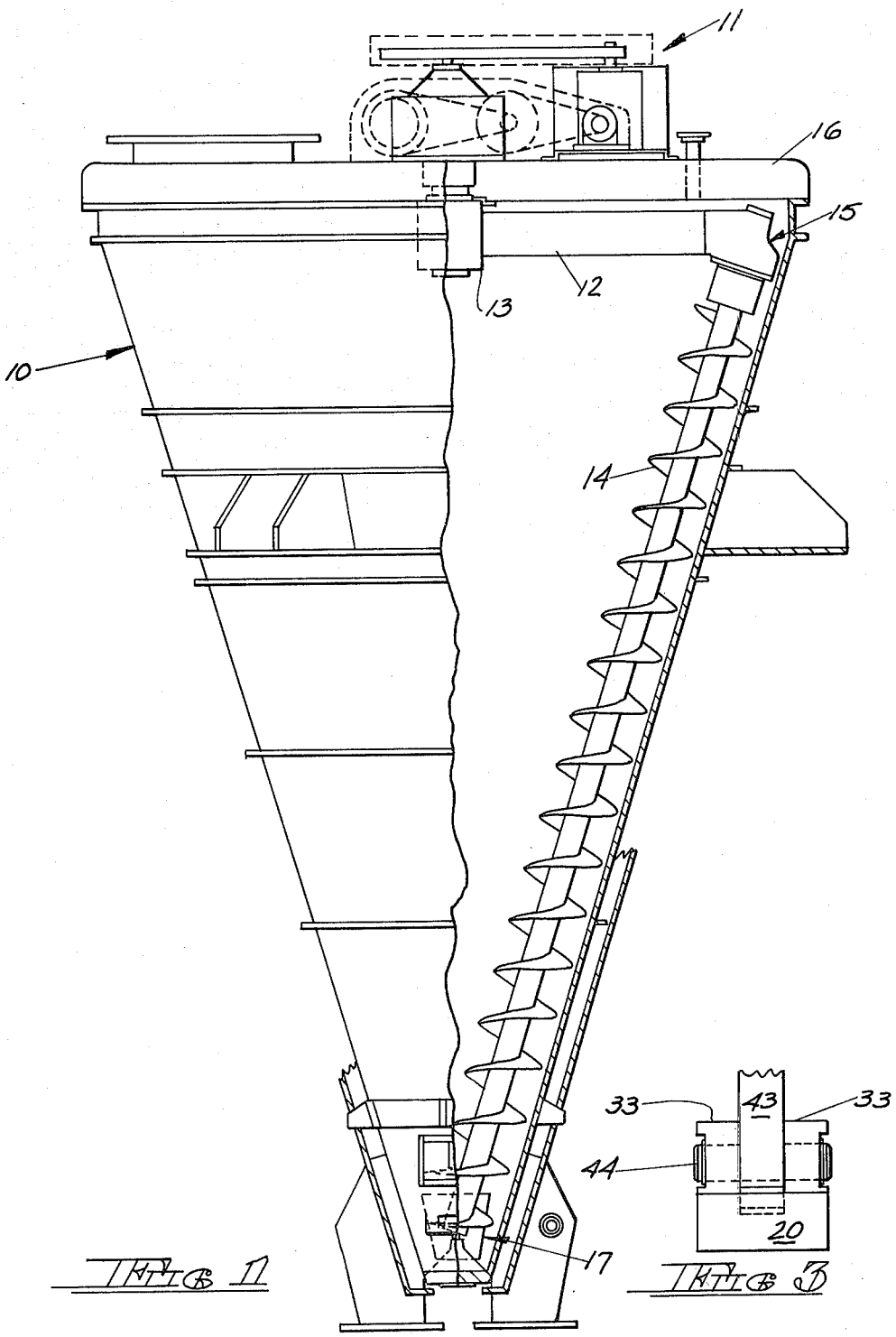
FIG. 1 is an elevational view, partly in section and with parts broken away, showing a single screw mixer to which the invention has been applied, certain of the arrangements having been shown diagrammatically and others schematically.
FIG. 3 is a fragmentary detailed view of the connection between the support shaft and connecting shaft comprising the "universal" joint of the lower support of this invention.

Referring first to FIG. 1 a typical single screw mixer 10 of the type to which the present invention is applied is depicted. Such mixer comprises an inverted, truncated cone having a motor drive assembly and gear means arrangement, all of which is generally indicated at 11, for rotating a swing or orbit arm 12 via the head 13 at relatively slow speeds on the order of 1 to 4 rpms; at the same time the motor, gear and head arrangement is such as to rotate the screw flight assembly 14 at relatively high speeds on the order of 30 to 120 rpms. A coupling assembly 15 achieves the driving arrangement for the screw flight 14 while at the same time absorbing screw deflections imparted thereto by the forces, including heat, encountered during the mixing operation. The upper end of the mixer may be closed by a plate or bridge 16 while the lower end of the screw may be supported by a support generally indicated at 17 and shown in detail in FIGS. 2 and 3. All of the foregoing, except for the detail of the lower support, is old and well known in the art and, therefore, has not been described in detail. It should also be noted that in practice the mixing cone will be suitably framed and provided with proper inlet and discharge ports, all as will be understood by those skilled in the art.

Figure 2:
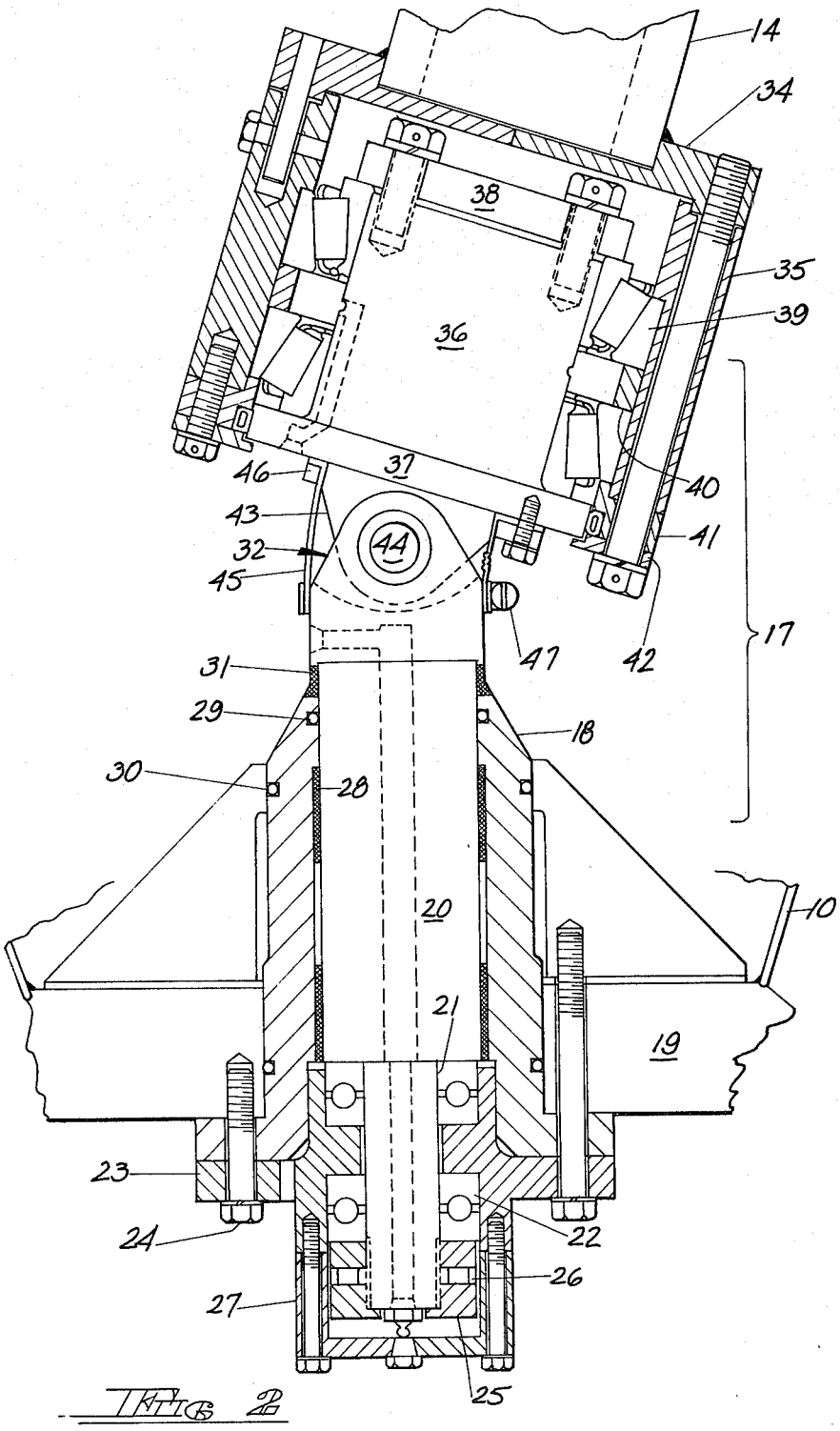
FIG. 2 is a greatly enlarged view of the bottom support provided for the screw at the lower end of the mixer, parts being shown in section and parts being broken away.

Referring now to FIGS. 2 and 3, the detail of the lower support 17 comprising this invention will now be described. A flanged support post 18 is located in the bottom flange 19 on the cone section of the mixer 10. A support shaft 20 is located within the post 18 and provided with an extension 21 of smaller diameter extending below the cone flange 19. A thrust bearing arrangement 22 located within a bearing housing 23 is provided about the support shaft extension 21. The housing 23 and post 18 may be secured to the cone flange 19 by suitable bolts 24 or the like. A bearing nut 25, provided with flat point set screws 26 to secure engagement of the nut on the support shaft extension 21, is provided at the lower end of such shaft extension. The bearing cover is indicated at 27.

Additional bearing support for the support shaft 20 may be provided as indicated at 28. O-rings 29 and 30 along with a check seal 31 may also be employed as will be understood by those skilled in the art. The upper end of the support shaft 20 terminates in a pair of "ears" defining a yoke or the like 32, see also FIG. 3.

Welded or otherwise fixed to the lower end of the screw flight 14 is an adapter flange 34; a bearing housing 35 is secured to that flange. Extending upwardly within the bearing housing 35 is a connecting shaft 36 having a lower flange 37. A bearing cap 38 is secured to the upper end of the connecting shaft 36. A bearing arrangement 39, including also a cup spacer 40, is located between the bearing cap 38 and shaft flange 37. A suitable seal gland 41 and seal retainer 42 are utilized as shown.

The lower end of the connecting shaft 36 terminates in a downwardly extending tang 43, see also FIG. 3. This tang 43 is received between the yoke or ears 33 of the support shaft 20 and aligned orifices are provided in the members 33 and 43 to receive a pin 44 therethrough.

From the foregoing it will be apparent that the support shaft 20 and connecting shaft 36 are connected via the yoke 32 and tang 43 and pin 44 in such manner that these shafts 20 and 36 move together at orbit speed only. Thus, while the connecting shaft 36 is received within the bearing housing 35 it is not drivingly connected thereto so that the screw speed is not imparted to these shafts. The adapter flange 34, bearing housing 35 and bearing arrangement 39 rotate at screw speed about the connecting shaft 36; the only speed imparted to the shaft 36 is that occasioned by the upper end of the screw 14 moving about the inner periphery of the cone assembly 10 as occasioned by the rotation of the swing arm 12 about the axis of the mixing cone.

The arrangement of the yoke ears 33, tang 43 and pin 44 enables the support shaft 20 and connecting shaft 36 to accommodate for wobble and deflection imparted to the screw by the forces encountered during mixing. The arrangement may be further protected by the use of a flexible boot 45, boot retainer 46 and hose clamp 47.

From the foregoing it will be seen that the lower support for single screw mixer of this invention provides a positive connection of the lower end of the screw to the lower end of the mixing cone so that the screw may be rotated in either direction if desired without danger of the support being interrupted. At the same time such lower supprt provides a "universal type" joint without imparting the relatively high screw speeds to the members forming such joint. The support shaft 20 and connecting shaft 36, as connected by the arrangement 33, 43 and 44, move in response to the swing or orbit arm 12 and only at orbit arm speed while permitting the screw to rotate at the relatively high speeds required for adequate mixing.

It is possible that modifications may be made in this invention by those skilled in the art. And while the invention has been shown and described in terms of particular structures and arrangements, it is to be understood that the invention is not limited to such structures and arrangements except insofar as they are specifically set forth in the subjoined claims.

I claim:

1. In a mixer having an inverted, truncated cone for a mixing chamber having also a top and a bottom, a horizontal orbit arm rotatable at a relatively slow speed about the axis of the mixer within the upper region thereof and with the outer end of said arm moving adjacent the inner periphery of said chamber, a mixing screw disposed parallel to the inner periphery of said chamber and rotatable on its own axis at a relatively high speed, coupling means attaching the upper end of said screw to the outer end of said orbit arm so as to permit linear movement between said screw and said arm, motor drive and gear means to rotate said orbit arm at its said slow speed and said screw at its said high speed, and a lower support for said screw, the improvement which is characterized by: said lower support comprising a rotatable vertical support shaft attached to the bottom of said chamber, an extension fixed on the lower end of said screw, a connecting shaft having one end freely received within said extension and the other end adjacent the upper end of said support shaft, and connecting means connecting said support shaft to said connecting shaft so as to permit a rocking movement therebetween while ensuring that said support shaft and said connecting shaft will rotate together at said slow speed only, said extension on said screw rotating about said connecting shaft at said high speed, whereby deflections imparted to said screw by the forces encountered during mixing are accommodated via said coupling means and said connecting means while said support shaft and said connecting shaft rotate at said slow speed only.

2. The lower support of claim 1 in which a thrust bearing is provided for said support shaft and a bearing arrangement is provided between said extension and said connecting shaft one end.

3. The lower support of claim 2 in which the upper end of said support shaft terminates in a pair of upstanding parallel ears and said other end of said connecting shaft terminates in a tang extending between said ears, said connecting means including a pin passed through aligned holes in said ears and tang to permit said rocking movement.

4. The lower support of claim 3 including a flexible boot secured between said support shaft and said connecting shaft to enclose said connecting means.

5. The lower support of claim 2 in which said support shaft terminates in a lower end of reduced diameter, a bearing housing fixed to said chamber bottom, said thrust bearing being located in said bearing housing and surrounding said lower end of reduced diameter, and means to retain said thrust being within said bearing housing.

6. The lower support of claim 2 in which said connecting shaft is provided with an exterior flange between its said one end and its said other end, a bearing cap on the upper end of said connecting shaft one end, said bearing arrangement being disposed within said screw extension between said flange and said cap.

7. A lower support for a single screw mixer, said mixer being comprised of an inverted, truncated cone, an orbit arm located within the upper region of the mixer and rotatable about the axis of the mixer, a mixing screw having its upper end operatively attached to the outer end of said orbit arm for relatively slow rotation about the inner periphery of said mixer, said screw being rotatable about its own axis at relatively high speed, coupling means between said orbit arm and said mixer to accommodate linear deflection which may be imparted to the screw by the forces encountered during mixing, and motor-gear means to rotate said orbit arm and said screw, said lower support for said screw being characterized by: a vertical support shaft rotatably mounted in the bottom of said mixer, a bearing housing attached to the end of said screw, a bearing arrangement within said bearing housing, a connecting shaft having an upper end received in said bearing arrangement, said bearing housing and said bearing arrangement and said screw being free to rotate about said connecting shaft, and a pin joining the upper end of said support shaft and the lower end of said connecting shaft so as to permit relative rocking movement therebetween, said support shaft and said connecting shaft moving together and in response to rotation of said orbit arm at said relatively slow rotation only while said bearing housing and said bearing arrangement and said screw rotate about said connecting shaft at said relatively high speeds.

* * * * *